United States Patent [19]

Car-Lai

[11] Patent Number: 4,843,935

[45] Date of Patent: Jul. 4, 1989

[54] DUAL-TONE ELECTRONIC MUSIC GENERATOR

[76] Inventor: Ma Car-Lai, Fl. 3, No. 88, Chung Hwa Road, Section 1, Taipei, Taiwan

[21] Appl. No.: 88,312

[22] Filed: Aug. 24, 1987

[51] Int. Cl.[4] ..... G10H 1/38

[52] U.S. Cl. ..... 84/1.03; 84/1.28; 84/DIG. 12; 84/DIG. 22

[58] Field of Search ..... 84/DIG. 22, DIG. 12, 84/1.01, 1.03, 1.28, DIG. 4

[56] References Cited

U.S. PATENT DOCUMENTS 3,889,568 6/1975 Amaya ..... 84/DIG. 12 X 4,581,759 11/1986 Takahashi ..... 84/1.28 X 4,587,878 5/1986 Nakada et al. ..... 84/1.28 X 4,633,751 1/1987 Fukaya et al. ..... 84/DIG. 22 X 4,742,748 5/1988 Tateishi ..... 84/1.28 X

*Primary Examiner*—Arthur T. Grimley

*Assistant Examiner*—John G. Smith

*Attorney, Agent, or Firm*—Varndell Legal Group

[57] ABSTRACT

An improved dual-tone electronic music generator provides a phase difference between a melody and a chord such that the melody codes converted from the melody and the chord codes converted from the chord can be stored into a memory in series. This arrangement can increase the memory usage efficiency, and can reduce both the chip size and the production cost.

2 Claims, 5 Drawing Sheets

DUAL-TONE ELECTRONIC MUSIC GENERATOR

BACKGROUND OF THE INVENTION

The instant invention relates to an improved dual-tone electronic music generator which provides a phase difference (2ms) between the melody and the chord. This permits both the melody codes and the chord codes, which are respectively converted from the original melody and chord, to be loaded into a common memory in series. Such an arrangement can increase the memory usage efficiency, and can reduce both the chip size and the production cost.

Referring to FIG. 1, the conventional dual-tone electronic music generator mainly comprises a pair of melody memory (10) and chord memory (11) which are associated with control circuits so the melody and the chord can be arranged to be synchronous with each other. However, since the number of notes for each of the melody and the chord of a music usually are different from each other, it is difficult to simultaneously select the desired melody from these two memories (10) and (11). In addition, as soon as one of the memories (10) and (11) are filled with codes, the other memory can no longer be utilized. Therefore, the aforesaid memories can not be adequately utilized. In an alternative configuration, the said two memories (10) and (11) can be combined into a single memory and the two address counters (12) and (13) can be combined into a single address counter. Although such an arrangement may reduce one address counter, the actual memories used therein are still the same. If one attempts to reduce the bits of the memory in order to save the hardware size, the chord codes, stored in said memory will be reduced accordingly, However, this may adversely affect the quality of the composed melody.

It is, therefore, an object of the present invention to obviate and mitigate the aforesaid drawbacks.

SUMMARY OF THE INVENTION

It is the primary object of the present invention to provide an improved dual-tone electronic music generator which can provide a phase difference between the melody and the chord such that the melody codes and the chord codes, respectively corresponding to said melody and chord can be stored into a single memory in series, and thereby the utilization efficiency of the memory can be significantly increased.

It is another object of the present invention to provide an improved dual-tone electronic music generator which can reduce both the chip size and the production cost.

DETAILED DESCRIPTION OF THE PREFERRED EMBODIMENT

Figure 1:
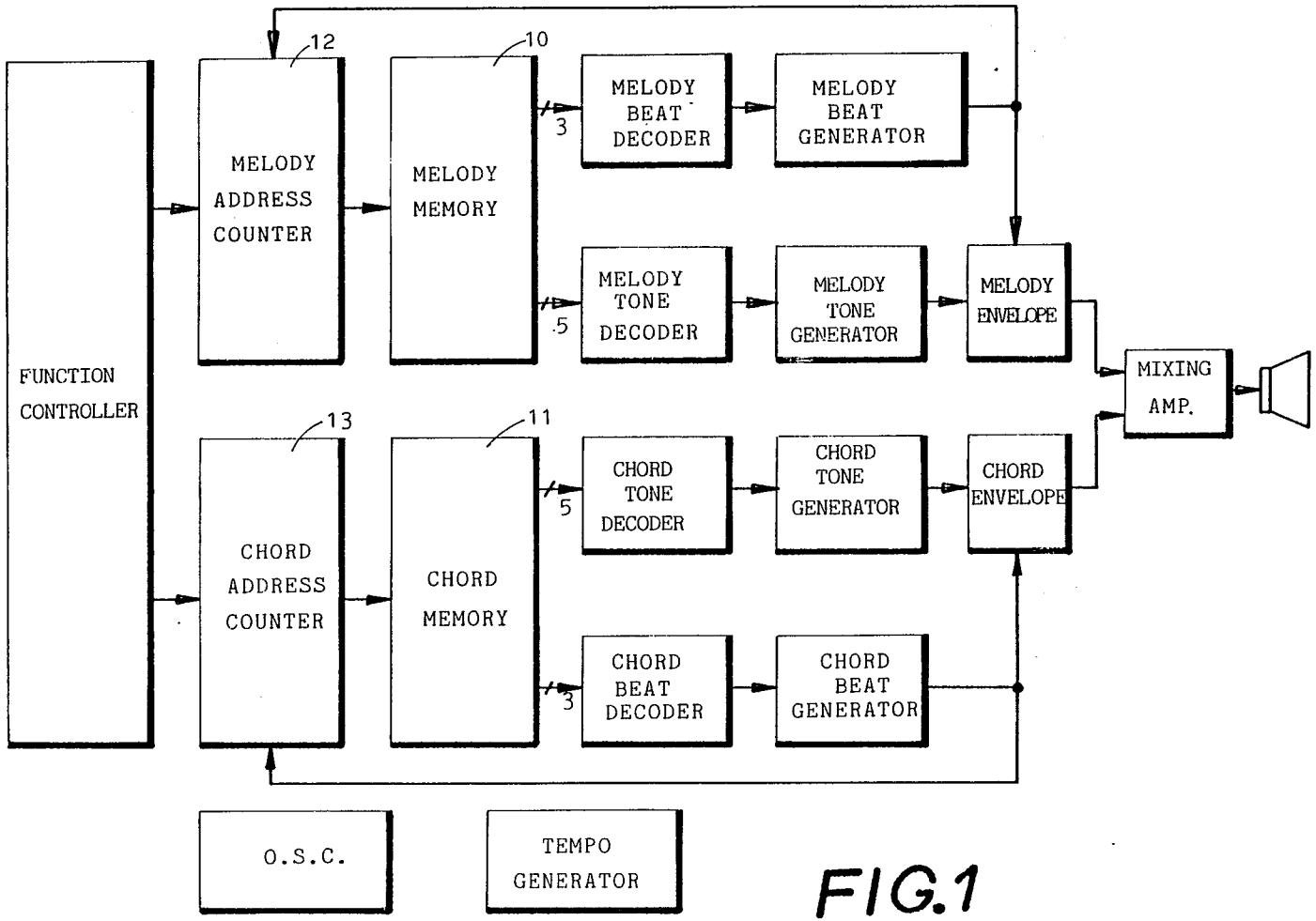
FIG. 1 is a block diagram of a conventional electronic music generator.
Figure 2:
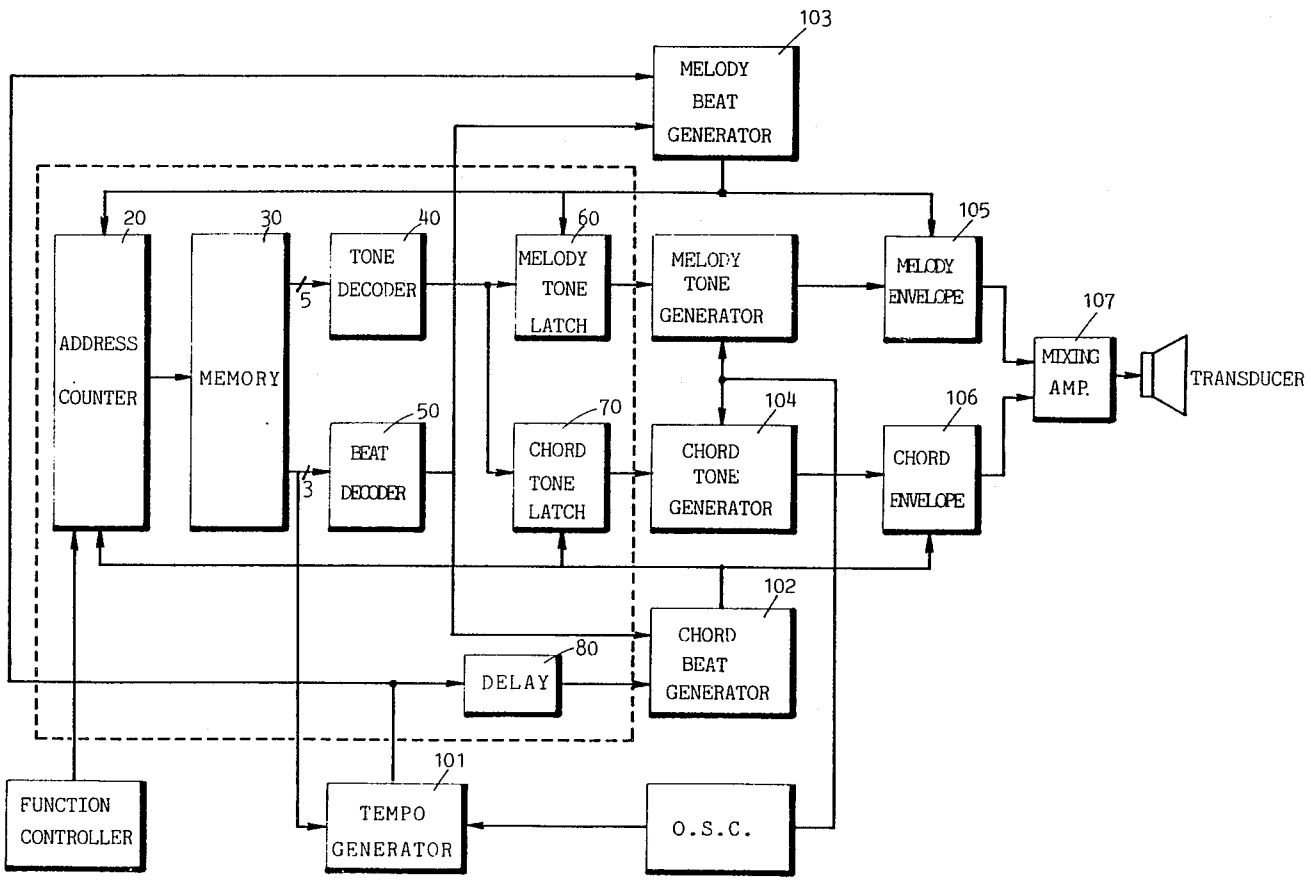
FIG. 2 is a complete block diagram of a dual-tone electronic music generator according to a preferred embodiment of the present invention.

Referring to FIG. 2, the major features of the instant dual-tone electronic music generator, as shown in the portion within the dashed line comprise an address counter (20), a memory (30), a tone decoder (40), a beat decoder (50), a melody tone latch (60), a chord tone latch (70) and a delay circuit (80). The remainder of FIG. 2 is a basic portion of the conventional dual-tone electronic music generator and will not be described herein.

Figure 4:
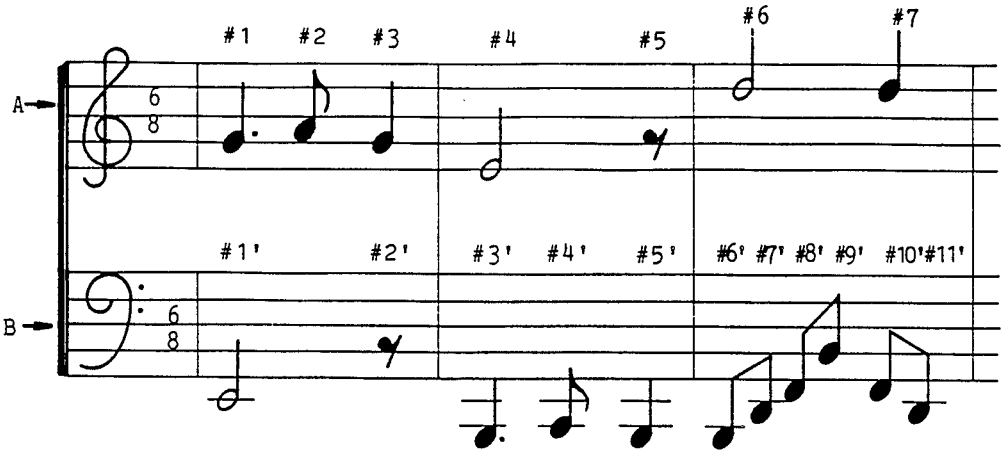
FIG. 4 is a schematic diagram showing an original stave of the present invention.

FIG. 4 shows an original stave which includes a melody and a chord. The original stave then is converted into a series of corresponding codes which adapt to the instant electronic music generator. These codes which are stored in the memory (30) are shown in the following table:

TABLE

| Address: | 00 | 01 | 02 | 03 | 04 | 05 | 06 | 07 | 08 | 09 | 0A | 0B | 0C | 0D | 0E | 0F | 10 | 11 . . . |
|---|---|---|---|---|---|---|---|---|---|---|---|---|---|---|---|---|---|---|
| | #1 | #1' | #2 | #3 | #2' | #4 | #3' | #4' | #5 | #5' | #6 | #6' | #7' | #8' | #9' | #7 | #10' | #11'. . . |

Figure 5:
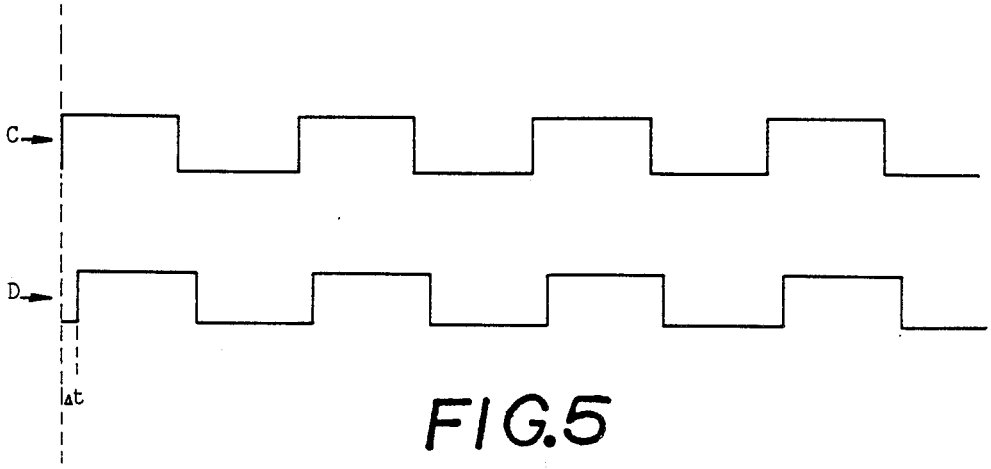
FIG. 5 is a schematic diagram illustrating the timing signals of a beat generator according to the present invention.

Referring to FIG. 5, there are a melody beat timing signal (C) and a chord beat timing signal (D). Since the frequencies of both timing signals (C) and (D) are the same, the beats of both melody and chord are synchronous to each other. In order to distinguish the codes stored in the memory (30), the phase difference between the melody beat timing signal (C) and the chord beat timing signal (D) is designed to be $\Delta t$ (for example, $\Delta t$ approxionately equals to 2 milliseconds (2 ms)), which will not be distinguishable by human's ears. Thus, the composed melody still can maintain the desired mixing tone effect.

Figure 6:
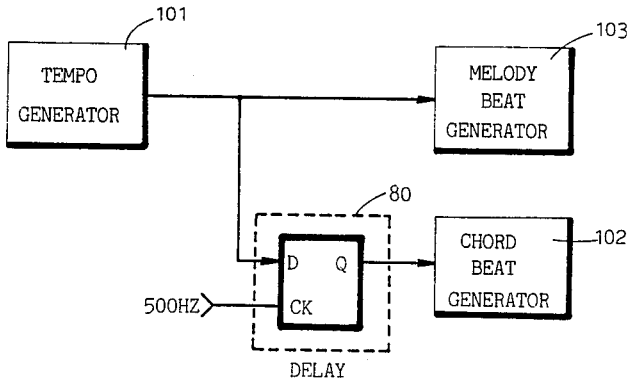
FIG. 6 is a delay circuit diagram of the present invention.

Referring to FIG. 6, the delay circuit (80) consisting of a flip-flop designed so that the signal, which is generated by the tempo generator (101) and is to be input to the chord beat generator (102), can be delayed by the delay circuit (80). In addition, the phase difference between the beat signals which are respectively generated by the melody beat generator (103) and the chord beat generator (102), can be, for example, 2 ms.

Figure 7:
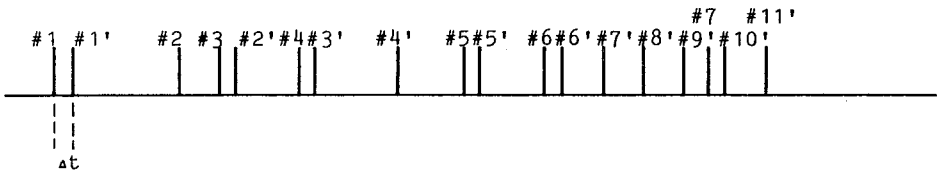
FIG. 7 is a schematic diagram illustrating the timing signals of an address counter according to the present invention.

FIG. 7 shows the timing signals of the address counter (20). The pulses respectively generated by the melody beat generator (103) and the chord beat generator (102) first pass through an OR gate. Then these pulses are input to the address counter (20). Since the phase difference between the timing signal of the melody beat generator (103) and that of the chord beat generator (102) is approximately 2 ms ($\Delta t$), the output codes from the memory (30) can be easily distinguished.

Figure 8:
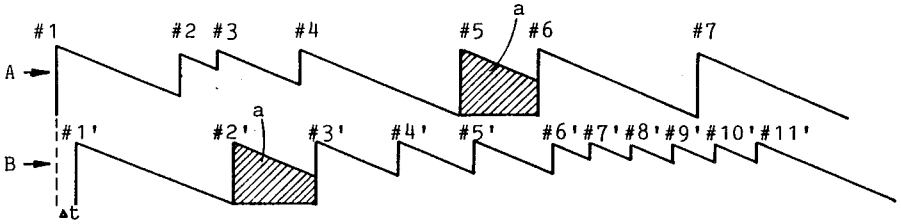
FIG. 8 is a schematic diagram showing the modulated output, and each of a melody and a chord according to the present invention.

FIG. 8 shows the modulated output waves which respectively represent the melody (A) and the chord (B). It can be seen that the phase difference between the melody and the chord is Δt (2 ms) which is so short that it will not be distinguishable by the human ears. In addition, the shading portion (a) of FIG. 8 represents a silent note.

In use, first, both the chord beat generator (102) and the melody beat generator (103) are reset to zero. Then, the tempo generator (101) generates a timing signal to actuate the aforesaid beat generators (102) and (103). Since the timing signal of the melody beat generator (103) leads that of the chord beat generator (102) by a phase difference Δt, the melody beat generator (103) will generate a first address timing signal. Accordingly, the memory (30) will output a melody tone code which can be latched by the melody tone latch (60). Then, the melody tone generator will generate a new frequency. The melody beat code will be loaded into the melody beat generator (103). After the passing of a predetermined time period Δt, the chord beat generator (102) will generate another address timing signal which in turn will be input to the address counter (20). At this instant, the chord tone code coming from the memory (30) will be latched by the chord tone latch (70), and then the chord tone generator (104) will generate a new frequency. The chord beat code will be loaded into the chord beat generator (102). The output signals respectively coming from the melody tone generator and the chord tone generator are respectively input to the melody envelope circuit (105) and the chord envelope circuit (106) to reshape their waveforms. Then, these reshaped wareforms are mixed and amplified by a mixing amplifier (107) to compose an attractive melody.

Figure 3:
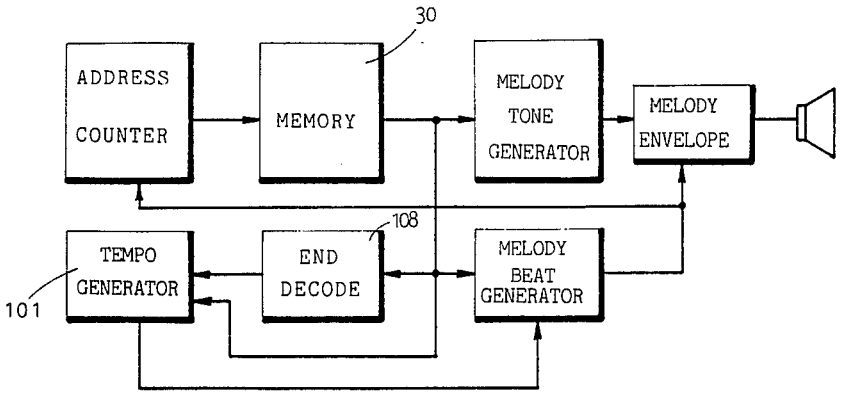
FIG. 3 is a block diagram showing an automatic speed adjusting unit of the present invention.

FIG. 3 is a block diagram which shows an automatic speed adjusting circuit. Whenever the end decoder (108) detects an end code, the end decoder (108) will automatically generate a "LOAD" signal to load a predetermined speed code from the memory (30) into the tempo generator (101), so it can provide a desired speed for the next melody.

In summary, the instant dual-tone electronic music generator possesses the following features:

1. The instant music generator can adjust the speed of a melody through the software adjustment. There are totally eight different speeds namely, 65 beats/min, 80 beats/min, 96 beats/min, 120 beats/min, 144 beats/min, 160 beats/min, 180 beats/min, and 240 beats/min. These speed adjustment codes can be combined with an end code of a previous melody to save the memory space.

2. The instant music generator can provide an appropriate phase difference (i.e., 2 ms) between the melody and the chord, so that both of the melody and the chord can be output in series. Using such an arrangement can obtain the following advantages:

A. The memory of the instant invention can be effectively utilized. The instant music generator can provide eight different beats with three bits and can furnish thirty-two different tones with five bits. Accordingly, the instant music generator can use only eight bits to achieve all its desired requirements.

B. The instant invention can use a single tone decoder and a single beat decoder. However, the conventional music generator has to utilize two tone decoders and two beat decoders.

C. The instant invention can provide a phase difference between the melody and the chord. This may avoid the possibility of an overflow.

I claim:

1. A dual-tone electronic music generator for providing a phase difference between a melody and a chord, which comprises:

a melody beat generator and a chord beat generator for respectively generating a series of address timing signals, an address counter for receiving said address timing signals, an 8-bit memory means for storing codes converted from a melody and a chord, said memory means being arranged so that three bits of memory are capable of providing eight different beats and five bits of memory are capable of providing thirty-two different tones, said codes including codes for speed adjustment of the melody to one of eight different speeds, said codes being capable of being combined with an end code of a previous melody for saving memory space, a tone decoder means for respectively decoding a series of melody tone codes and chord tone codes received from said memory means based upon a phase difference therebetween, a melody tone latch and a chord tone latch for respectively latching a decoded melody tone and a decoded chord tone received from said tone decoder means, and a melody tone generator and a chord tone generator for respectively generating corresponding new frequencies respectively from said decoded melody tone and said decoded chord tone, received from said melody tone latch and said chord tone latch, a beat decoder for respectively decoding melody beat codes and chord beat codes received from said memory means and for respectively loading said decoded melody beat codes and said decoded chord beat codes into said melody beat generator and said chord beat generator;

a delay circuit means for providing a delay between said address timing signals and for creating a phase difference between consecutive address timing signals of approximately 2 milliseconds, said delay circuit means including a flip flop and a tempo generator arranged so that when said tempo generator generates a timing signal, receipt of said timing signal by said chord beat generator is delayed by said flip flop, so that resultant data generated by said memory means is delayed to the extent that said tone decoder means can distinguish between a code for melody and a code for chords.

2. The dual-tone electronic music generator of claim 1, wherein means are provided for outputting tones resulting from said melody tone generator and said chord tone generator through a mixing amplifier with said phase difference therebetween.

* * * * *